US011396022B2

(12) United States Patent
Nordell

(10) Patent No.: US 11,396,022 B2
(45) Date of Patent: Jul. 26, 2022

(54) MONO ROLLER GRINDING MILL

(71) Applicant: CANADA MINING INNOVATION COUNCIL, Ottawa (CA)

(72) Inventor: Lawrence K. Nordell, Monroe, WA (US)

(73) Assignee: CANADA MINING INNOVATION COUNCIL, Ottawa (CA)

( * ) Notice: Subject to any disclaimer, the term of this patent is extended or adjusted under 35 U.S.C. 154(b) by 20 days.

(21) Appl. No.: 16/554,455

(22) Filed: Aug. 28, 2019

(65) Prior Publication Data

US 2020/0070175 A1 Mar. 5, 2020

Related U.S. Application Data

(60) Provisional application No. 62/723,841, filed on Aug. 28, 2018.

(51) Int. Cl.
*B02C 15/06* (2006.01)
*B02C 15/00* (2006.01)

(52) U.S. Cl.
CPC ..... *B02C 15/004* (2013.01); *B02C 15/007* (2013.01); *B02C 15/06* (2013.01)

(58) Field of Classification Search
CPC ..... B02C 15/06; B02C 15/003; B02C 15/004; B02C 15/007; B02C 15/10
USPC ..... 241/228
See application file for complete search history.

(56) References Cited

U.S. PATENT DOCUMENTS 244,316 A 7/1881 Sample
303,125 A 8/1884 Corcoran
438,633 A 10/1890 Marshall
760,010 A 5/1904 Montgomery
851,013 A 4/1907 Loehnert
971,153 A 9/1910 Sherrerd
987,850 A 3/1911 Braddock
1,092,185 A 4/1914 Thomas
1,130,644 A 3/1915 Steinbach
(Continued)

FOREIGN PATENT DOCUMENTS

CN 1189109 A 7/1998
CN 1222099 A 7/1999
(Continued)

OTHER PUBLICATIONS

International Searching Authority, ISR and Written Opinion, PCT/US 0770472, dated May 15, 2008, 9 pages.
(Continued)

*Primary Examiner* — Faye Francis
(74) *Attorney, Agent, or Firm* — Norton Rose Fulbright Canada LLP

(57) ABSTRACT

A crushing mill with a single roller inside a driven cylindrical shell inner surface, both with horizontal and parallel but offset axes is disclosed. In some embodiments, the roller has protrusions such that as the roller and shell rotate rock or other material may be crushed between the shell and the roller, respectively. In some embodiments, the shell and the roller each have surface protrusions such that rock or other materials may be crushed between the shell and the roller as they rotate. In some embodiments the shell and the roller operate at differential speeds with respect to each other to induce shear forces on the material to be crushed.

14 Claims, 7 Drawing Sheets

(56) References Cited

U.S. PATENT DOCUMENTS

| | | | | | |
|---|---|---|---|---|---|
| 1,174,160 | A | | 3/1916 | Jensen | |
| 1,291,008 | A | | 1/1919 | Jensen | |
| 1,315,025 | A | | 9/1919 | Lawler | |
| 1,351,793 | A | | 9/1920 | Schmidt | |
| 1,470,420 | A | | 10/1923 | Askin et al. | |
| 1,539,237 | A | | 5/1925 | Borcherdt | |
| 1,591,938 | A | | 7/1926 | Harrison | |
| 1,607,404 | A | | 11/1926 | Archibald | |
| 1,741,604 | A | | 12/1929 | Frederick | |
| 1,947,505 | A | | 2/1934 | Pelt | |
| 2,045,687 | A | | 6/1936 | Armstrong | |
| 2,189,711 | A | | 2/1940 | Eigenbrot | |
| 2,261,257 | A | | 11/1941 | Kiesskalt et al. | |
| 2,406,904 | A | | 9/1946 | Roberts | |
| 2,698,144 | A | | 12/1954 | Reiffen | |
| 2,875,955 | A | | 3/1959 | Wendshuh | |
| 2,993,656 | A | | 7/1961 | Ratkowski | |
| 3,061,205 | A | | 10/1962 | Wilfrid | |
| 3,078,049 | A | | 2/1963 | Hardinge | |
| 3,184,171 | A | * | 5/1965 | Daman | B02C 17/10 241/41 |
| 3,204,878 | A | * | 9/1965 | Peacock | B02C 17/10 241/15 |
| 3,206,128 | A | | 9/1965 | MacPherson et al. | |
| 3,404,846 | A | | 10/1968 | MacPherson et al. | |
| 3,580,520 | A | | 5/1971 | Leroy | |
| 3,596,841 | A | * | 8/1971 | Perry | D21B 1/063 241/38 |
| 3,610,542 | A | | 10/1971 | Takashi | |
| 3,865,541 | A | | 2/1975 | Burwell et al. | |
| 4,009,634 | A | | 3/1977 | Barmore | |
| 4,136,832 | A | | 1/1979 | Morita et al. | |
| 4,176,799 | A | | 12/1979 | Clin et al. | |
| 4,194,710 | A | | 3/1980 | Ebner | |
| 4,200,242 | A | | 4/1980 | Ueda | |
| 4,211,369 | A | | 7/1980 | Eigner | |
| 4,243,182 | A | | 1/1981 | Dugger, Jr. | |
| 4,265,408 | A | | 5/1981 | Voelskow | |
| 4,289,279 | A | | 9/1981 | Brandt | |
| 4,373,675 | A | | 2/1983 | Kaufman | |
| 4,389,020 | A | | 6/1983 | Clin et al. | |
| 4,424,938 | A | | 1/1984 | Day | |
| 4,448,357 | A | | 5/1984 | Harlow et al. | |
| 4,580,734 | A | | 4/1986 | Eroskey et al. | |
| 4,635,860 | A | | 1/1987 | Kruyer | |
| 4,919,344 | A | | 4/1990 | Mckie | |
| 5,205,494 | A | * | 4/1993 | Durinck | B02C 15/06 241/30 |
| 5,269,471 | A | | 12/1993 | Yamagishi | |
| 5,393,000 | A | * | 2/1995 | Lagache | B02C 17/22 241/228 |
| 5,743,475 | A | | 4/1998 | Catani | |
| 5,752,665 | A | | 5/1998 | Wason | |
| 5,839,490 | A | | 11/1998 | Kiedaisch et al. | |
| 5,845,855 | A | | 12/1998 | Yamada et al. | |
| 5,884,856 | A | | 3/1999 | Isaji | |
| 5,899,394 | A | * | 5/1999 | Folsberg | B02C 15/06 241/29 |
| 6,179,233 | B1 | * | 1/2001 | Cordonnier | B02C 23/18 241/61 |
| 6,193,177 | B1 | * | 2/2001 | Chevalier | B02C 15/06 241/57 |
| 6,206,310 | B1 | | 3/2001 | Schneider | |
| 6,630,277 | B2 | | 10/2003 | Naka et al. | |
| 7,497,395 | B2 | | 3/2009 | Nordell | |
| 8,955,778 | B2 | | 2/2015 | Nordell | |
| 9,140,295 | B2 | * | 9/2015 | Romero | F16C 27/02 |
| 9,675,977 | B2 | * | 6/2017 | Cordonnier | B02C 23/00 |
| 9,687,853 | B2 | | 6/2017 | Nordell | |
| 10,343,174 | B2 | | 7/2019 | Nordell | |
| 2014/0326810 | A1 | * | 11/2014 | Cordonnier | B02C 15/06 241/3 |
| 2016/0310952 | A1 | | 10/2016 | Nordell | |
| 2019/0329262 | A1 | | 10/2019 | Nordell | |
| 2020/0070175 | A1 | | 3/2020 | Nordell | |

FOREIGN PATENT DOCUMENTS

| | | | |
|---|---|---|---|
| EP | 0486371 | A2 | 5/1992 |
| RU | 2065771 | C1 | 8/1996 |
| RU | 2198030 | C2 | 10/2003 |
| SU | 727225 | A1 | 4/1980 |
| SU | 995877 | A1 | 2/1983 |
| SU | 1002081 | A1 | 3/1983 |
| SU | 1138006 | A | 1/1985 |
| WO | 2009050723 | A1 | 4/2009 |
| WO | 2012125834 | A2 | 9/2012 |
| WO | 2016172338 | A1 | 10/2016 |
| WO | 2020047160 | A1 | 3/2020 |

OTHER PUBLICATIONS

International Searching Authority, ISR and Written Opinion, PCT/US 2012029237, dated Jun. 7, 2012, 4 pages.

International Searching Authority, ISR and Written Opinion, PCT/US 2016/028640, dated Sep. 8, 2016, 6 pages.

International Searching Authority, ISR and Written Opinion, PCT/US2019/048656, dated Dec. 12, 2019, 8 pages.

EAPO, Office Action for Eurasian Patent Organization Application No. 202190636 dated Sep. 27, 2021.

CNIPA, Office Action and Search Report for CN Application No. 2019800567677 dated Mar. 29, 2022.

INAPI, Office Action and Search Report for Chilean patent application No. 498-2021 dated Apr. 7, 2022.

* cited by examiner

MONO ROLLER GRINDING MILL

RELATED APPLICATIONS

This application claims priority benefit of U.S. Ser. No. 62/723,841 filed Aug. 28, 2018, the contents of which are incorporated herein by reference.

BACKGROUND OF THE DISCLOSURE

Field of the Disclosure

This disclosure relates to rock (material) grinding mills and more particularly to a roller grinding mill having a single roller therein, where the roller and outer ring (shell) surface cooperate to comminute material, and where the roller "floats" on the material being comminuted within the shell. The roller in one example is not connected to a drive system. The roller in one example does not have a pressure system connected exterior of the roller to increase pressure against the shell.

Background Art

For many industrial purposes it is necessary to reduce the size of rather large rocks or other material to a smaller particle size (commonly called "comminution"). For example, the larger rocks may be blasted out of an area such as a hillside, pit or mine, and these larger rocks are then directed into a large rock crusher, which is typically the first stage of comminution after blasting. The blasted rock sizes can exceed 1000 mm (>40 inches) in size. The resulting output of the crusher is typically smaller rock that is less than 200 mm (8 inches) in a longest dimension which is then fed to a grinding mill or similar device. Such a grinding mill typically comminutes the crushed rock down to 50 mm (>2 inches) sized rocks or less.

One common grinding mill comprises a large cylindrical grinding section, rotating along its horizontal axis, which in one example has a diameter of ten to fifty feet. One such mill is described in U.S. Pat. No. 7,497,395 incorporated herein by reference. The material (rocks or other material), along with optionally water or air, are directed into one end of the continuously rotating grinding section, which in one example comprises various types of lifting ribs (lifters) positioned axially on the inside surface of the grinding section to carry the material upwardly, on its surface, in a curved upwardly directed path within the grinding chamber so that this partially ground material tumble back onto other material in the lower part of the chamber. Thus, this material impacts other material components, and the inner surface of the grinding mill, optional bars, optional balls, etc., and the material is broken up into smaller fragments. In some examples large iron balls (e.g., two to six inches in diameter) are placed in the grinding chamber to obtain improved results.

It takes a tremendous amount of power to operate many examples of these grinding mills, and also there are other substantial costs involved in maintenance, operation, and repair. There are a number of factors which relate to the effectiveness and the economy of the operation, and the embodiments of the disclosure are directed toward improvements in such grinding mills and the methods employed.

SUMMARY OF THE DISCLOSURE

Disclosed herein are several embodiments of a mono roller grinding mill (MRGM). The mono roll grinding mill comprises an outer (anvil) ring, tube, or shell. The outer ring or anvil in one example has a substantially cylindrical structure with a substantially cylindrical inner surface. The shell in one example is supported on bearing pads or rollers beneath the shell. The shell rotates about a horizontal axis in use as the material therein is comminuted. The shell defines a substantially cylindrical chamber where material is placed during comminution. The MRGM in one form has a roller located within the shell, the roller in one example comprising a substantially cylindrical structure forming a substantially cylindrical outer surface. The shell may have openings to allow sized (crushed) rock to be flushed out of the machine during the anvil-roller rotation. In another example, combinable with the openings, a shield is provided with opening(s) therein for passage of material into and out of the mill. Since the centers or axes of the shell and roller are offset, their rotation causes a closing action of their surface distances to a minimum gap, where the highest compression stress is applied to the material. The shell inner surface and roller outer surface create a surface texture that grabs and captures the material during their concurrent rotating motion, forcing the material into a smaller and smaller available gap, as the roller compresses and comminutes the material against the shell, resulting in slow-steady compression fracture of the material.

In some embodiments, the shell and roller each have surface protrusions, such that rock or other materials may be captured between protrusions and then crushed between the shell and roller as they rotate In some embodiments, the roller has one or more circumferential annular ridges that fit within circumferential annular groove(s) of the shell such that material is crushed between the shell and the roller, due to the offset centers of the shell and roller. In this way, the shell and roller may operate at differential speeds with respect to each other to induce shear forces, as well as compression action on the material to be crushed. In this later embodiment, the circumferential ridges may have transverse ridges to restrain the rock which allows a compressive and shear comminution action to be applied to the material captured between ridges when the inner and outer rings rotate out of unison.

DESCRIPTION OF THE PREFERRED EMBODIMENTS

Figure 2:
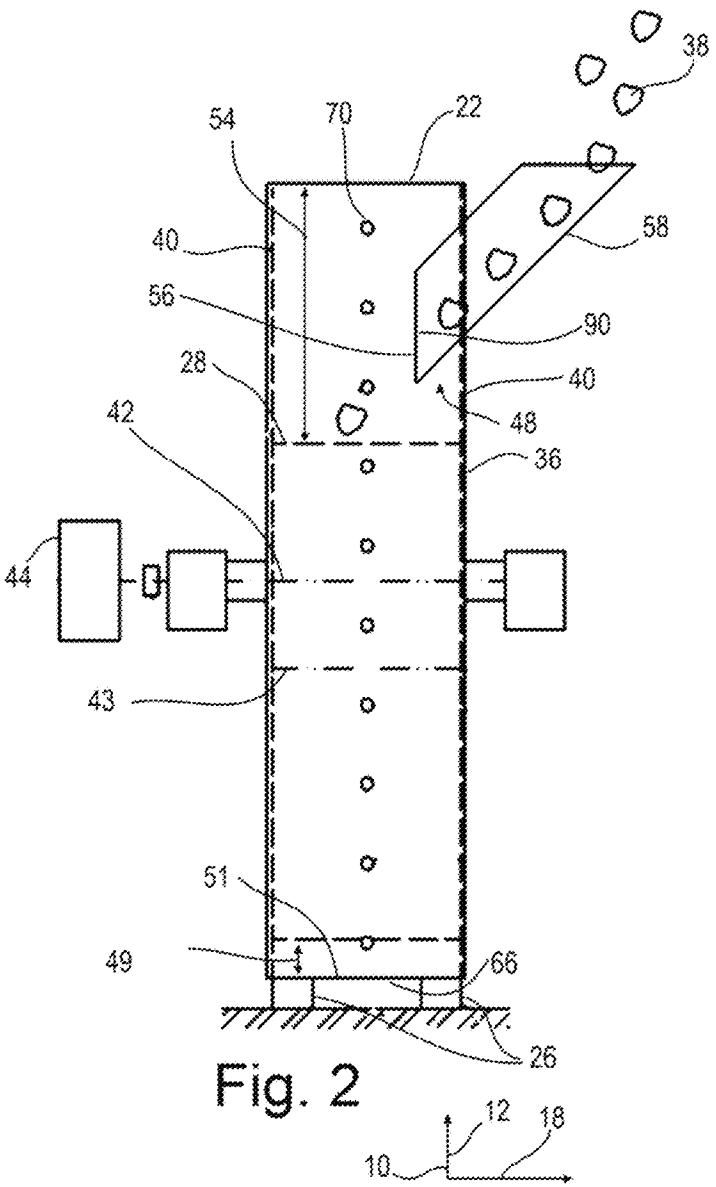
FIG. 2 is a cross sectional side view of the embodiment of FIG. 1

In the following disclosure, various aspects of a mono roll grinding mill (MRGM) 20 will be described. Specific details will be set forth in order to provide a thorough understanding of the disclosure. In some instances, well-known features may be omitted or simplified in order not to obscure the disclosed features. Repeated usage of the phrase "in one embodiment" or "in one example" does not necessarily refer to the same embodiment or example, although it may.

An axes system 10 is shown and generally comprises a vertical axis 12, an anvil radial axis 14 extending radially outward from the center of the anvil (outer) ring 22, a roller radial axis 16 extending radially outward from the center of the roller (inner) ring 28, and a lateral axis 18. The lateral axis 18 is generally aligned with the axes of rotation of the shell 22, and the axes of rotation of the roller 28. These axes and directions are included to ease in description of the disclosure and are not intended to limit the disclosure to any particular orientation.

In several examples herein, a reference system is used comprising a numeric identifier and an alphabetic suffix. The numeric identifier labels a general element and an alphabetic suffix is used in some examples to show a specific embodiment of the general element. For example, the general shell is identified in FIG. 1 as 22, while one specific embodiment is shown as 22*a* in FIG. 3.

To ensure clarity, the term "material" is used herein to indicate rock, mineral matter of variable composition, consolidated or unconsolidated, assembled in masses or considerable quantities, as by the action of heat or water and equivalent materials. The material (for example rock) may be unconsolidated, such as a sand, clay, or mud, or consolidated, such as granite, limestone, or coal. While not normally defined as rock, equivalent materials such as hardened concrete may also be used in the disclosed mill and are included in the term "material".

Figure 1:
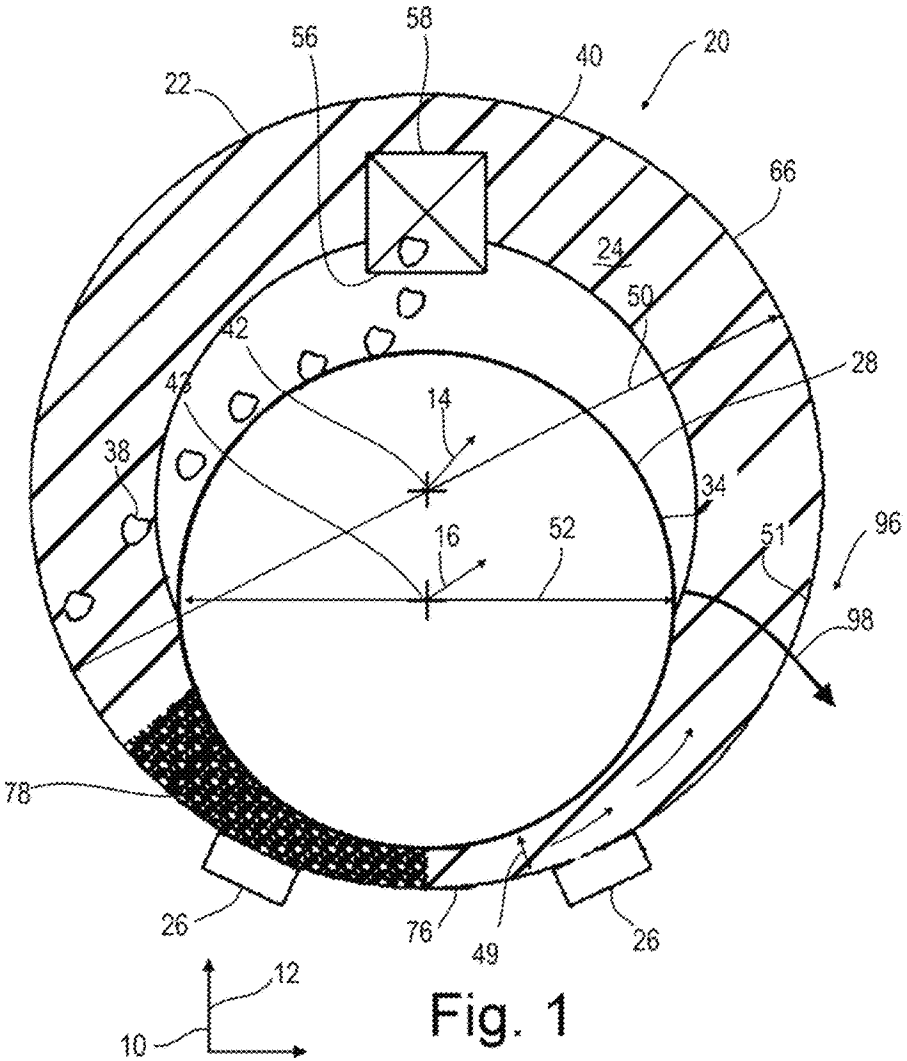
FIG. 1 is a cross-sectional, end view, of one embodiment of the disclosed MRGM.

FIG. 1 is a cross-sectional end view of an embodiment of a Conjugate Anvil Hammer Mill (CAHM) 20 with a floating roller. The term floating indicating that the roller may not be provided with a pressure device external of the roller 28. Such external pressure systems are disclosed in U.S. Pat. No. 8,955,778 filed on Mar. 15, 2012 incorporated herein by reference. This embodiment of the CAHM comprises an outer shell 22 having a substantially cylindrical inner surface which defines a chamber 24. The shell 22 is supported in one form by bearing pads 26. Bearing pads 26 may include bearings, lubricants, and/or friction resisting materials.

The outer shell 22 in one example rotates about a first longitudinal center axis 42. This outer shell 22 in in one example has a plurality of pockets or corrugations (not shown in FIG. 1, but shown in later figures), which interoperate with the roller 28 located within the outer shell 22. The inner roller 28 in one form comprising a substantially cylindrical outer surface 34 which in one form is mounted to an axial shaft 30 to rotate about a longitudinal axis which is parallel to and offset from the axis 42 of the outer shell 22, the inner roller 28 in several embodiments having a plurality of protruding elements or ridges such as the protruding elements 32 for example of FIG. 10 attached to or formed with the outer surface 34 of the roller 28, the protruding elements 32 in this form configured to increase efficiency of comminution as the inner roller 28 and shell 22 rotate.

Material 38 is inserted into the chamber 24 and comminuted between the outer surface 34 of the inner roller 28 and the inner surface 51 of the outer shell 22. The material 38 may be mixed with a fluid (water) to aid in transport down the shell 22 and aid in comminution. In some embodiments, retaining shields 40 are positioned at the shell outer edges to contain material before and during comminution.

As can be seen, there may be a lateral gap 36 between the inner end surface of the shell 22 or retaining shield 40 and the end of the roller 28. Thus, the feeding point 56 of the chute 58 may be inserted laterally 18 inward to form an overlap distance 48 such that material 38 inserted is less likely to be deposited in the gap 36.

The density, size, shape, and weight of the roller may be specifically configured to maximize comminution based on shell configuration, and material to be comminuted.

In FIGS. 1 and 2, an embodiment of the roller 28 is shown positioned inside the shell 22, wherein the rotational axes 43/42 of each ring are shown. In this embodiment, the shell 22 may be powered by a motor 44 and may rest on external bearings (pads 26).

In one example, the shell 22 is supported by hydrodynamic bearing pads 26 exerting lifting/supporting force on the outer surface 66 of the outer shell 22. An embodiment is shown where the motor 44 drives the axle of the shell 22. the outer surface 28 of the roller 28 engages the inner surface 51 of the shell 22 to transmit rotational force to the roller 28.

In another example, a motor may alternatively or cooperatively drive the roller 28 by way of a gearing system on the outer surface thereof, or other apparatus such as a belt, or chain drive.

In some embodiments, the roller 28 may be pressed against the shell 22 by additional force, such as by filling the roller 28 with fluids (e.g. water) or other solids (e.g. sand). In one example it is desired to minimize the circumference of the roller 28 to maximize compression in a small fracture zone 78 where a larger circumference would more evenly distribute this pressure. By utilizing the weight of the roller 28 to comminute material 38 with no external pressure/drive system, power consumption directed toward forcing the roller 28 against the shell 22 can be decreased relative to prior art embodiments. This configuration operates as a constant-pressure system, rather than constant gap mill. As In this configuration, if material 38 is too hard to crush, the gap 49 between the outer surface 34 of the roller 28 and the inner surface 51 of the shell 22 will increase, rather than jamming or damaging the MRGM 20. Thus, the floating embodiment where the roller 28 is allowed to float on the material 38 above the inner surface 51 of the shell 22 increases efficiency of the apparatus in many applications.

In some embodiments, the inner roller 28 has an outer diameter 52 sized between 50% and 80% of the inner diameter 50 of the outer shell 22.

One example uses an inner roller 28 with an outer diameter 52 which is 0.2 (20%) of the inner diameter 50 of the outer shell 22. Another ratio between outer diameter 52 of roller 28 and inner diameter 50 of the shell 22 may be between 0.65 and 0.7. This ratio represents a trade-off between (a) a larger inner roller 28 to improve the mechanical crushing advantage and longer wear life of the shell 22 to comminute material, and (b) a smaller shell 22 can comminute lighter throughput and be able to crush larger material due to the clearance 54 at the feeding point 56 as shown in the top of FIG. 2.

In one example, the roller 28 diameter is no less than 0.2 of the shell 22 inner diameter to ensure that pressure between the roller and the shell are adequate for breakage (comminution) of the material.

Figure 12:
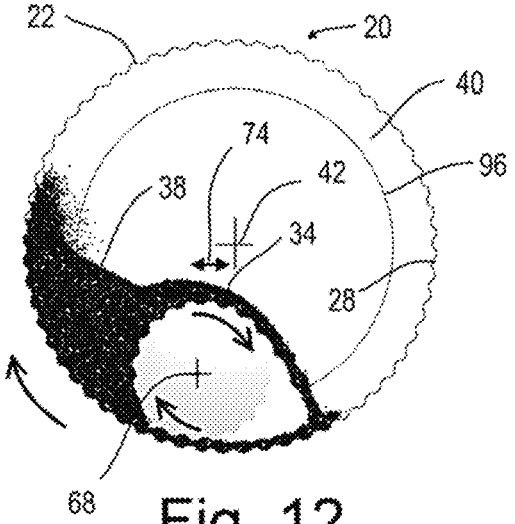
FIG. 12 is a cross sectional end view of one example of the MRGM in use.
Figure 14:
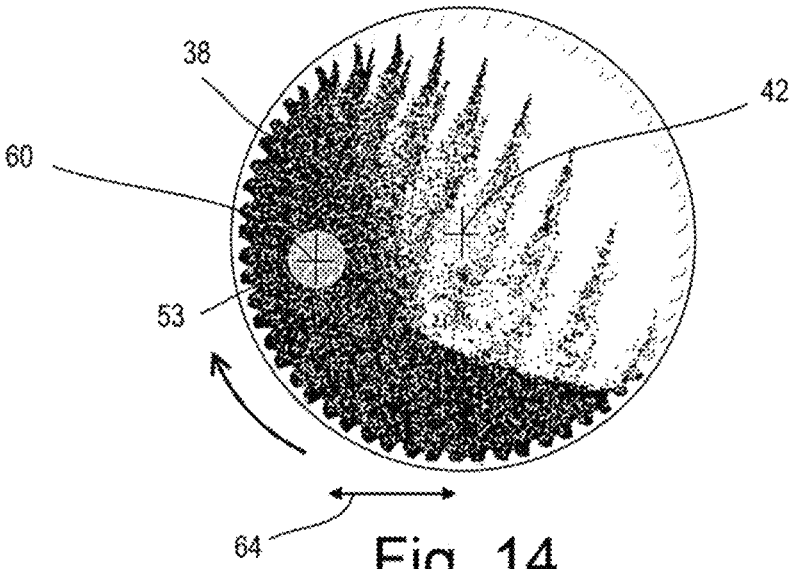
Fig. 14 Prior Art
FIG. 14 is a cross sectional end view of a prior art mill in use.

Looking to FIG. 14, the center of mass 60 common in mills including ball mills and rod mills is seen offset from the center 42 of the shell 22 by a distance 64. This offset creating torque on the system, and greatly reducing efficiency of the overall system. Looking to FIG. 12 is shown the center of mass 68 of a MRGM where the distance 74 is significantly reduced.

This torque and associated inefficiency can be further reduced where the center 43 of the roller 28 is very near the lateral position of the center 42 of the shell 22 and the speed of the shell 22 is set such that the material 38 does not build up at any location. In such an arrangement, the speed of the shell 22 in cooperation with the depth of the protruding elements 33 on the shell 22, size/mass/density of the material 38, inner diameter 50 of the shell 22 such that the material 38 is centrifugally forced toward the shell 22 and in each rotation of the shell 22 passes around the roller 28. Combined with lateral 18 movement of the material 38, this results in a helical transport 82 of the material down the shell 22 to an ejection port 96 laterally in opposition to the chute 58.

Operation of one embodiment of the MRGM 20 will now be explained. Rock to be comminuted is fed into the mill in one example from a chute 58 that guides the material (rock) 38 into the chamber 24 between the outer shell 22 and inner roller 28. Rotation of the shell 22 conveys the material 38, by rotation and gravity to the comminution gap 49 between the shell 22 and the roller 28, as the roller 28 applies pressure, and impacts with other material in the MRGM 20, comminuting the material 38 within the shell 22 by way of compression fracture of the material (rock). In this embodiment, the material 38 then passes through an grate or opening or equivalent exit 96 or may be further comminuted by the rotating action of the shell 22 and roller 28 in a following rotation. In the examples shown in FIGS. 3-11 and 12, a shield 40 forms a ring attached to the shell 22. The shield 40 in one example rotates with the shell 22 and as the material 38 passes over the inner edge of the shield 40, it exits the mill 20. This inner edge may be configured to maintain the roller 28 within the shell 22. This retaining shield may be positioned on either lateral end of the shell 22.

Figure 10:
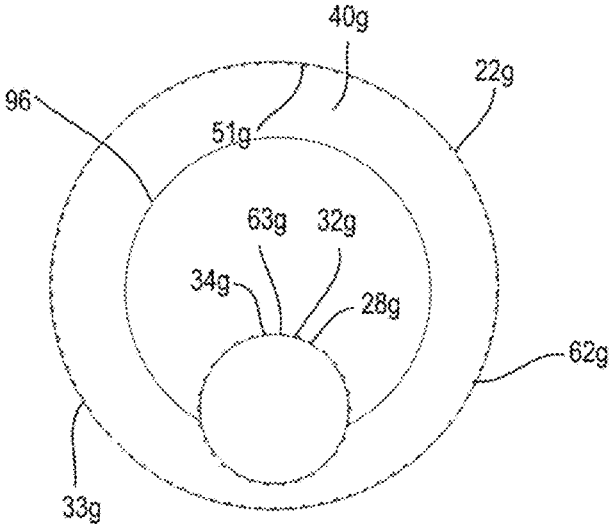
FIG. 10 is a cross sectional end view of another example of the MRGM.

In some embodiments, the textured surfaces 62 of the shell 22 and/or textured surfaces 63 of the roller 28 as shown by way of example in FIG. 10 assist in breaking the material 38. In one previously described example the shell 22 is rotated by an external drive (motor 44) either near a central region as shown in FIG. 2 or adjacent the bearing pads 26 on the perimeter, or other methods. The material 38 generally does not conform to the surfaces 62/63; thus the material 38 will commonly bridge from one texture surface to another in a two, three, or more point contact compression resulting in shear fracture of the material 38. As each protruding element 32 contacts the material 38, the material will tend to fracture and break.

In one example (G) as shown by way of example in FIG. 10, the roller 28*g* includes protruding elements 32. The inner surface 51 of the shell 22 may be smooth or may include protruding elements 33.

Figure 3:
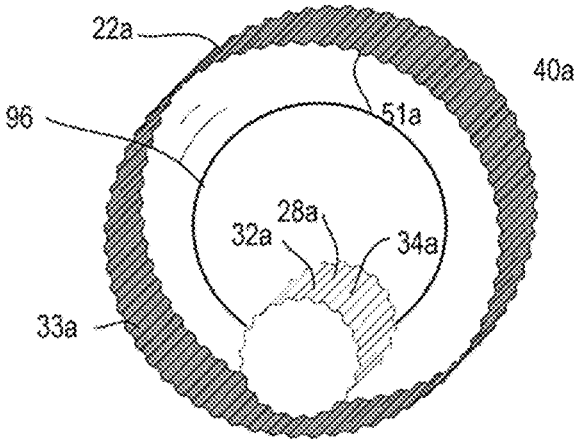
FIG. 3 is a cross sectional perspective end view of one example of the MRGM.
Figure 4:
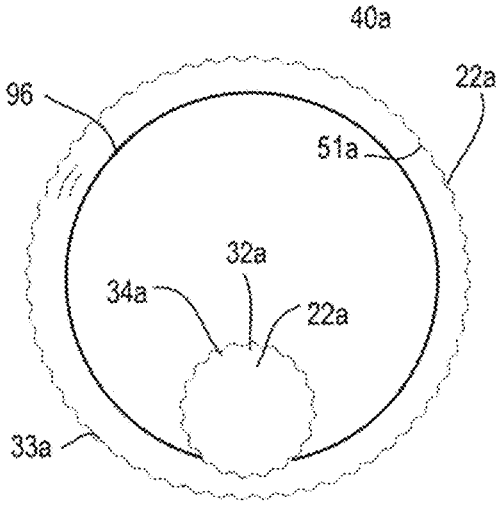
FIG. 4 is a cross sectional end view of the example of the MRGM shown in FIG. 3.

Looking to the example of FIG. 3 and FIG. 4, an example (A) is shown where the protruding elements 32*a* on the roller 28*a* comprise ridges that extend laterally 18 down the roller 28*a*. Similarly, the inner surface 51*a* of the shell 22*a* may comprise protrusions 33*a* that form ridges that extend laterally 18 down the shell 22*a*.

Figure 5:
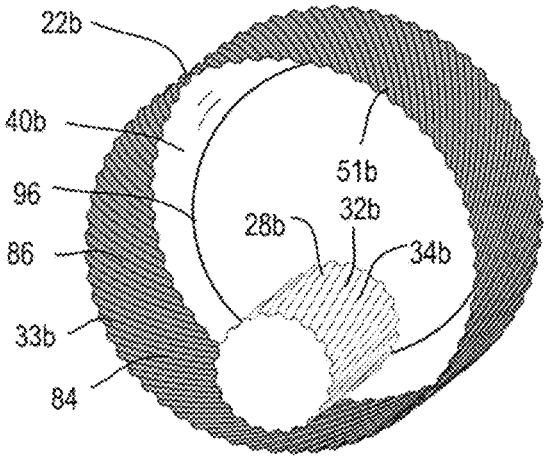
FIG. 5 is a cross sectional perspective end view of another example of the MRGM.

Looking to the example shown in FIG. 5, the shell 22*b* and the roller 28*b* have protrusions 32*b* and 33*b* comprising ridges that extend helically down the shell 22*b* and/or roller 28*b*. The ridges on the shell 22*b* of this example are not parallel to the ridges on the roller 28*b*, and are substantially orthogonal at the compression fracture zone 78. In one example, these ridges are configured to manipulate the material 38 as it passes laterally 18 down the shell 22*b* towards the exit 96 so as to maximize efficiency by controlling the number of circumferential passes through the compression fracture zone 78.

Figure 7:
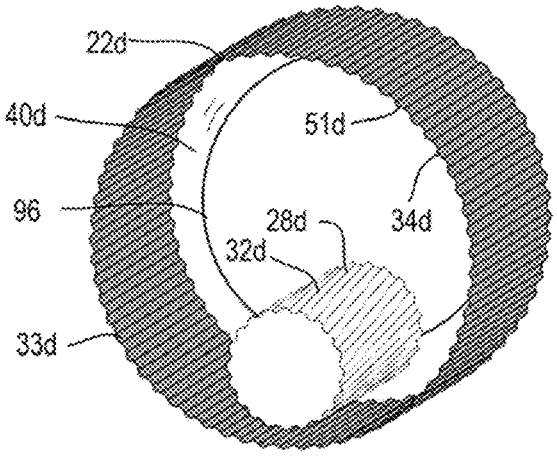
FIG. 7 is a cross sectional perspective end view of another example of the MRGM.

Looking to FIG. 7 is shown an example where the shell 22*c* and the roller 28*c* have protrusions 32*c* and 33*c* comprising ridges that extend down the shell 22*c* and roller 28*c*. The ridges on the shell 22*c* are generally laterally aligned and the ridges on the roller 28*c* are substantially helical, thus they are not parallel to the ridges on the shell 22*c*, and in this example are substantially orthogonal at the compression fracture zone 78. In one example, these ridges are configured to manipulate the material 38 as it passes laterally 18 down the shell 22*c* towards the exit end so as to maximize efficiency by controlling the number of circumferential passes through the compression fracture zone 78.

Figure 6:
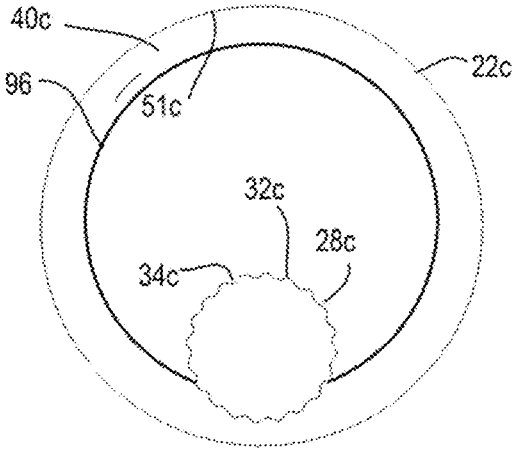
FIG. 6 is a cross sectional end view of another example of the MRGM.

In the example shown in FIG. 6, the roller 28*c* has protrusions 32*c*, while the shell 22*c* is substantially smooth on the inner surface.

Figure 8:
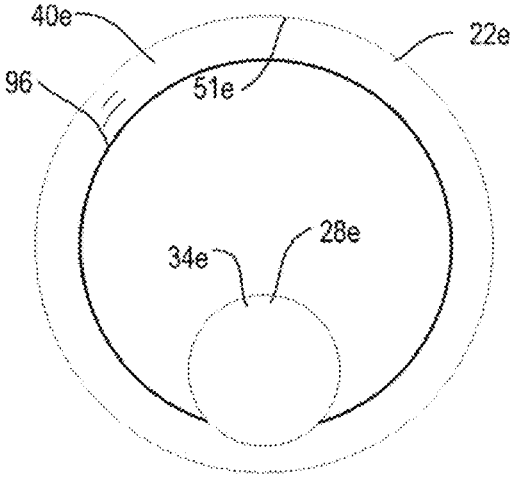
FIG. 8 is a cross sectional end view of another example of the MRGM.

In the example shown in FIG. 8, each of the roller 28*e* and the shell 22*e* have adjacent surfaces that are substantially smooth.

Figure 9:
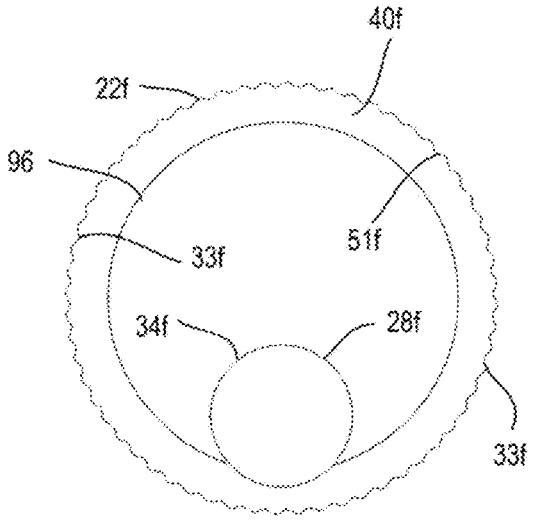
FIG. 9 is a cross sectional end view of an example of MRGM.

In the example shown in FIG. 9, the shell 22*f* has protrusions 33*f*, while the roller 28*f* is substantially smooth on the inner surface 51*f*.

In the example shown in FIG. 10, the shell 22*g* and the roller 28*g* have protrusions 32*g* and 33*g*.

Figure 11:
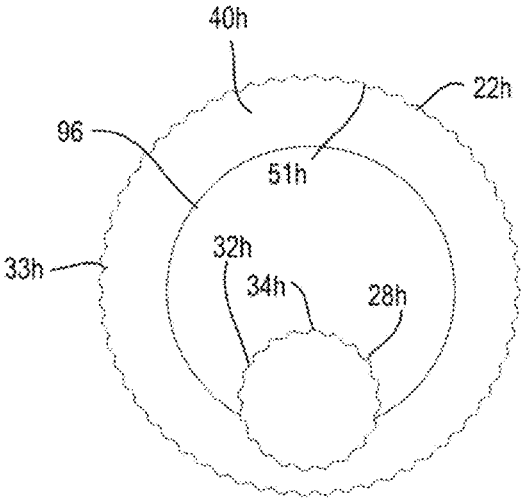
FIG. 11 is a cross sectional end view of another example of the MRGM.

In the example shown in FIG. 11, the shell 22*h* and the roller 28*h* have protrusions 32*h* and 33*h*. These protrusions are circumferentially asymmetric, forming ramps with a leading surface of a different configuration (angle or curvature) than the trailing surface relative to the direction of material flow 98.

Figures 20, 21, 22:
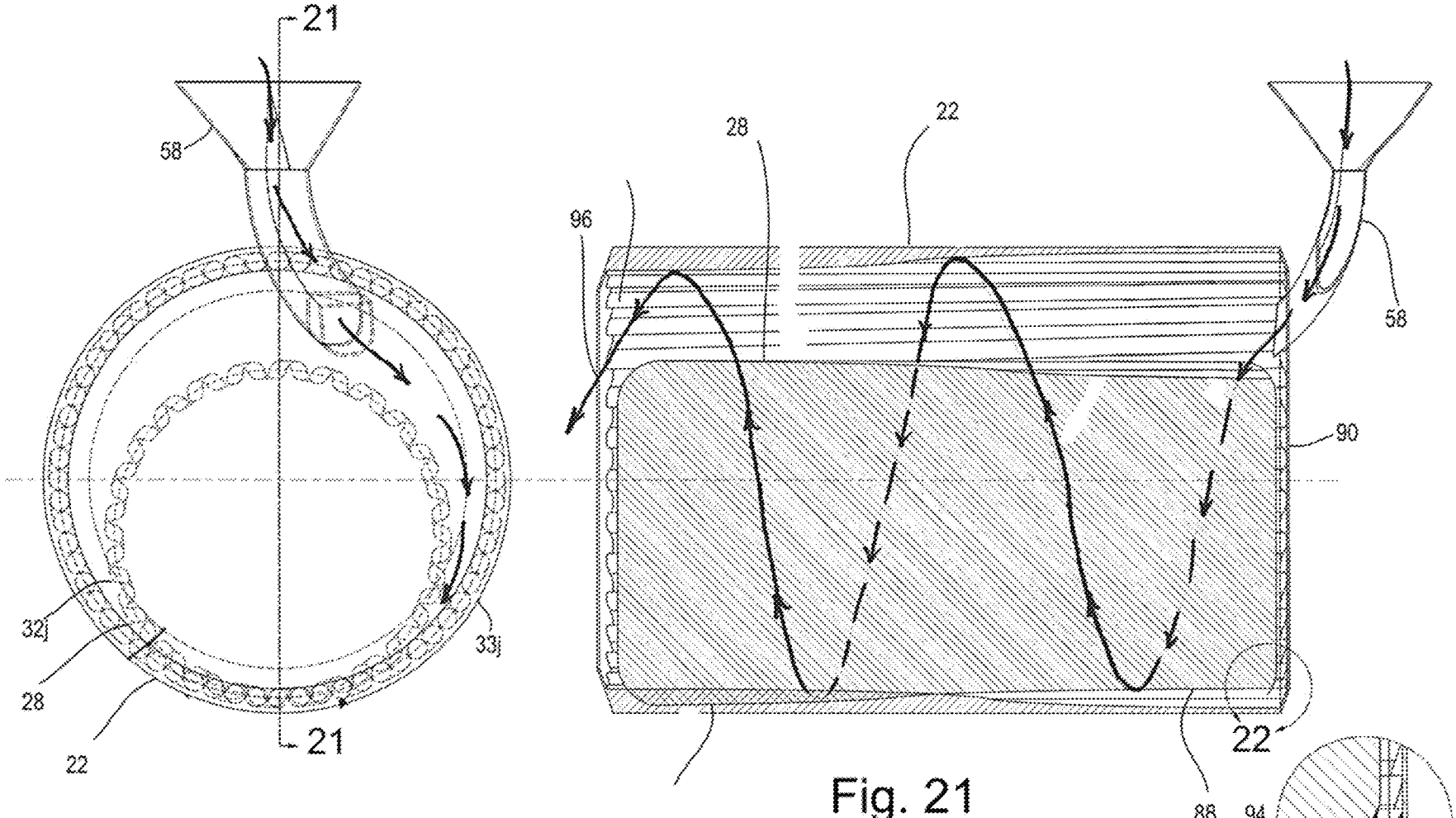
FIG. 20 is an end view of another example of the MRGM shown in FIG. 1.
FIG. 21 is a cross-sectional view taken along line 21-21 of FIG. 20.
FIG. 22 is a detail view of the region 22 of FIG. 21.
Figure 24:
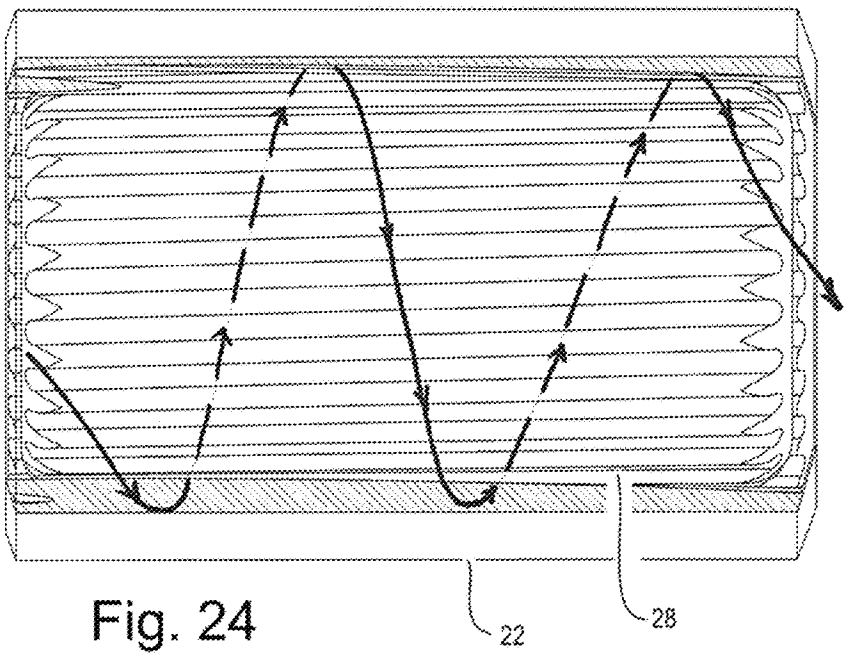
FIG. 24 is a cross-sectional view taken along line 18-18 of FIG. 17.
Figure 23:
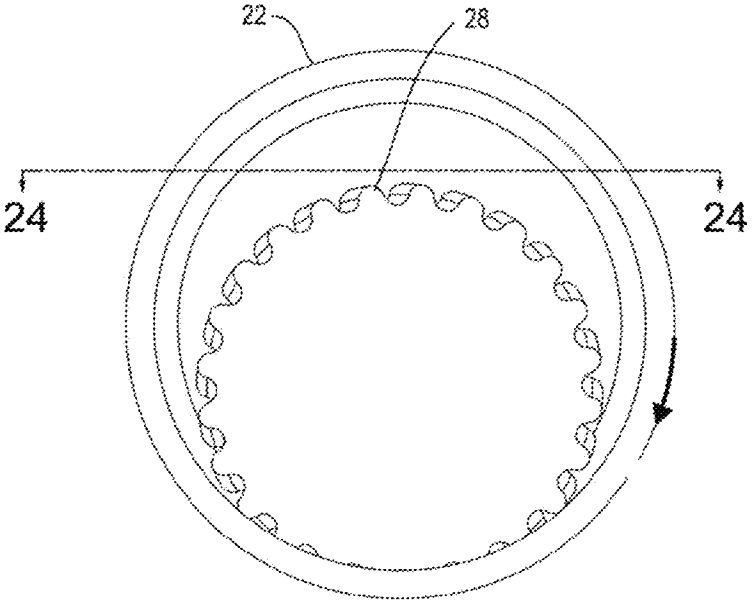
FIG. 23 is an end view of another example of the MRGM shown in FIG. 1.

In the example shown in FIG. 20-22 each of the shell 22*j* and roller 28*j* comprise protruding elements 33*j* and 32*j* respectively that extend laterally 18 and circumferentially down the MRGM 20. The protrusions 33*j* and 32*j* nest together as a worm gear type arrangement, facilitating lateral movement of the material 38 from the inlet 58 to the exit 96.

During initial startup of the MRGM 20, an initial buildup of material 38 is anticipated at a loading end location 88. This may result in tilting of the roller 28 as shown in FIG. 21, resulting in lateral movement of the roller 28 relative to the shell 22. In at least one example, this lateral movement may be unexpectedly toward the feed end 90. Thus, a fillet 92 (rounded edge) may be formed on the inner lateral end(s) of the shell 22 as well as a cooperating fillet 94 on the lateral end(s) of the roller 28.

In one example this tilting is temporary, as the material 38 begins to exit at the ejection port 96 the system is more balanced. In other examples, the MRGM 20 is configured to maintain such a tilt, so as to improve efficient movement of material 38 from the chute 58 to the ejection port 96.

In at least one example, the shell 22 may not have an even inner diameter 50 down the lateral length thereof but may be a frusta-conic shape to improve material movement. Similarly, the roller 28 may not have an even outer diameter 52 down the lateral length thereof, but may be a frusta-conic shape to improve material movement.

The roller 28 in one example is preferably positioned by gravity to achieve the desired gap 72 between shell 22 and roller 28. One preferable position is achieved when broken material surface area is maximized for a given shell 22.

In one example, material 38 is contained in the chamber 24 by the moving shell 22 and a shield 40. In one example the feed chute 58 passes through or around the shield 40 chamber 24. The shield(s) withhold the material from escaping the mill 20 at undesired positions during comminution.

Figure 18:
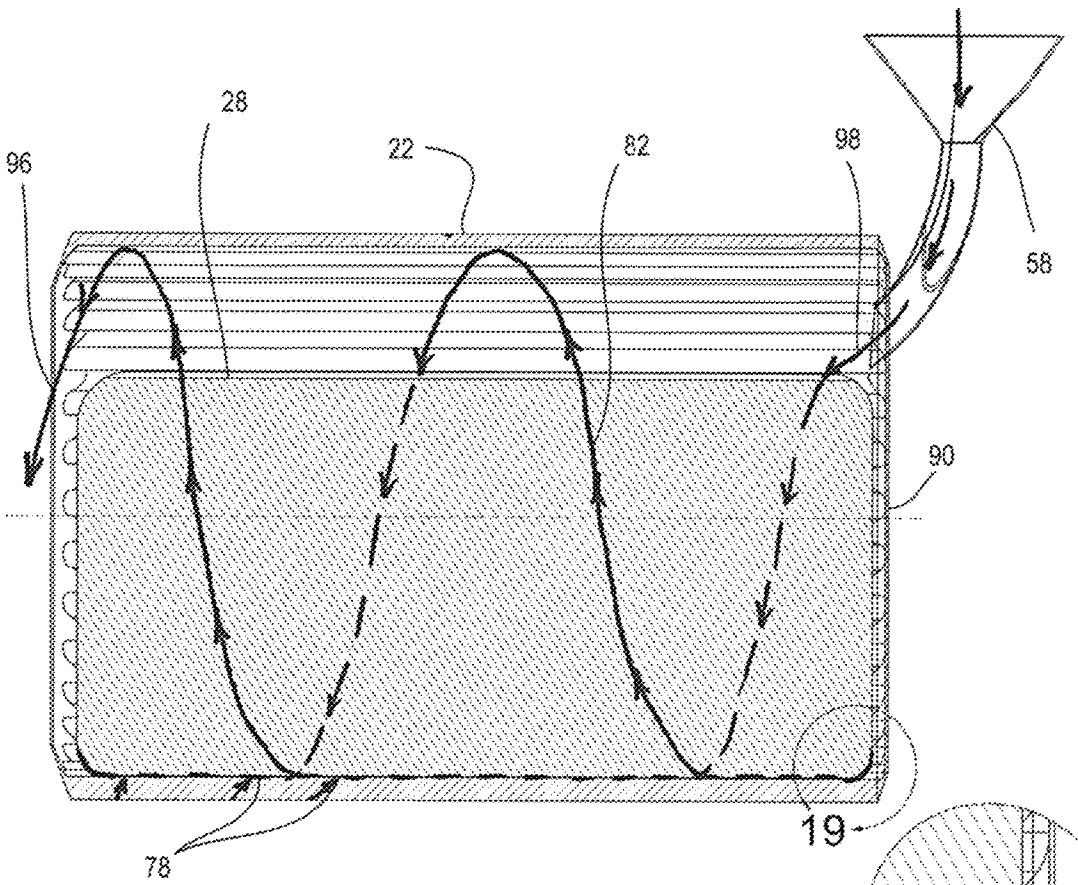
FIG. 18 is a cross-sectional view taken along line 18-18 of FIG. 17.
Figure 19:
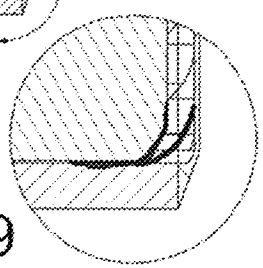
FIG. 19 is a detail view of the region 19 of FIG. 18.
Figure 17:
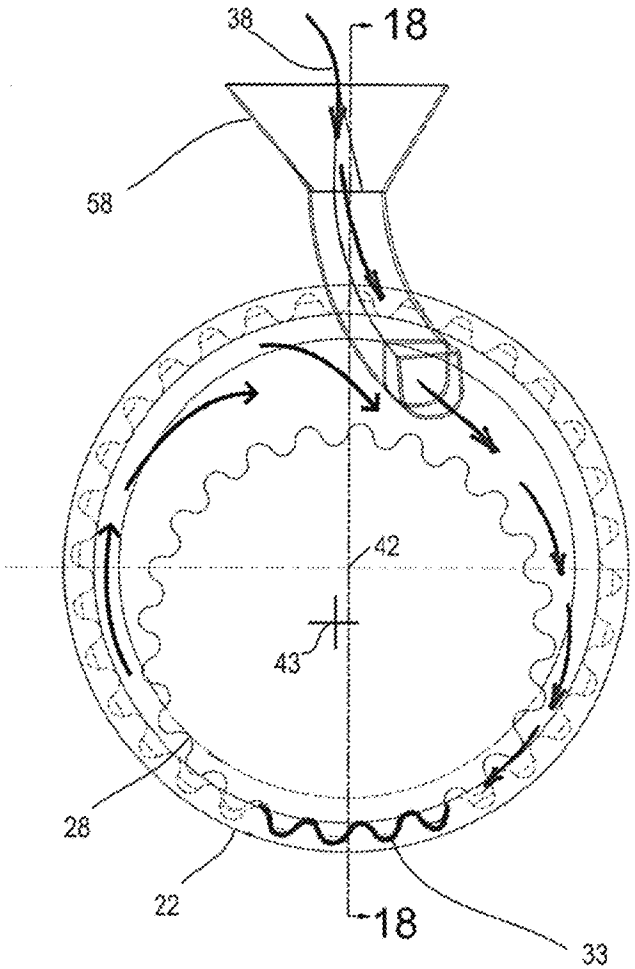
FIG. 17 is an end view of another example of the MRGM shown in FIG. 1.

In some embodiments, once the material 38 is crushed and rotates counterclockwise past a 6 o'clock position 76 (the 6 o'clock position being the position of minimum gap 49 between the two rings as shown in FIG. 3) a desired number of rotations as shown in FIG. 18 and in FIG. 21, most of the material will exit the mill 20 either through the openings 70 or through an opening in the shield 40. In these embodiments, retention of the comminuted matter will aid in crushing more of the remaining matter as is understood by looking to FIG. 12-16 where it can be seen that the material 38 tumbles, slides, and commutates the other material 38 as contact is made. In these figures it can be seen that the kidney, or shape of the comminuted material 38 is affected by the roller 28, and the roller 28 thus imparts additional pressure in the compression fracture zone 78.

FIG. 14 shows a mill 20 rotating at a relatively high rate of speed without a roller, where the material 38 travels further circumferentially around the shell 22 and drops onto the kidney 53. Such examples do not control a compression fracture zone 78 and thus are less efficient than an MRGM 20.

Additionally, some embodiments allow material 30 to re-enter the compression fracture zone 78 as shown in FIG. 1, 18, 21 to create a finer ground material and/or to make a most efficient MRGM 20. To this end, grates or classifiers of various designs known in the art may be utilized. For example, one example may involve grinding the material with successively finer grinding surface features between the shell 22 and roller 28 (axially from one side of the ring to the other side, parallel to the axis of rotation), whereby material 38 is fed from one lateral end of the mill 20 and discharged out the opposite lateral end. For example, an embodiment may have multiple stages of coarse to fine grinding in the same mill 20, moving material dimensional geometries from large roller, to fine pin mesh as rock axial motion is utilized by trapping comminuted material 38 as the material 38 rotates up the shell 22 inner surface 51 or by tilting the mill 20 on its rotating axis 42.

In some embodiments, the shell 22 may be mechanically driven by a motor 44 or equivalent device. For example, the shell 22 may rest on a ring and pinion gear system that drives the shell by the motor 40 or engine. The roller 28 is not connected to any control or drive apparatus, and thus floats on the material 38 during comminution. This makes modification of existing mills easy as the roller 28 may simply be inserted to replace multiple rods, balls, driven rollers, etc. No control or drive mechanism need be provided to the roller 28. The control is the design of the outer surface of the roller 28 relative to the inner surface 51 of the shell, and the size, weight, density of the roller 28.

In one example, the roller 28 has a first diameter at a first end, and a second diameter at other positions there along to control lateral 18 movement of material 38 along the mill 20. In one example the roller is tapered along the lateral length to accomplish this. The protrusions on the roller, and on the shell may be configured to maximize the benefits of this geometry.

In one example the core of the roller 28 may be made of a different material than the outer surface. For example, the core may be made of lead, while the outer surface is steel, to maximize density, comminution efficiency, and life of the roller 28.

Figure 15:
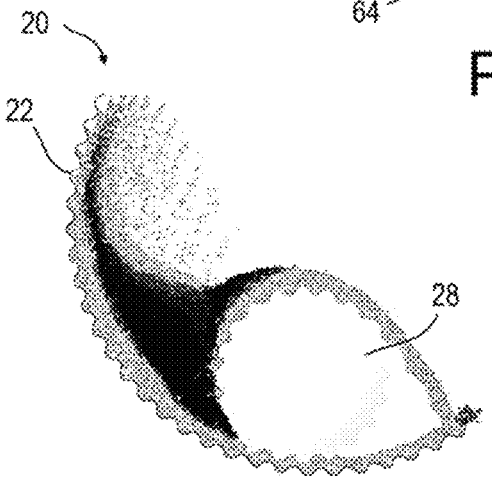
FIG. 15 is a cross sectional end view of the example of the MRGM shown in FIG. 12.
Figure 16:
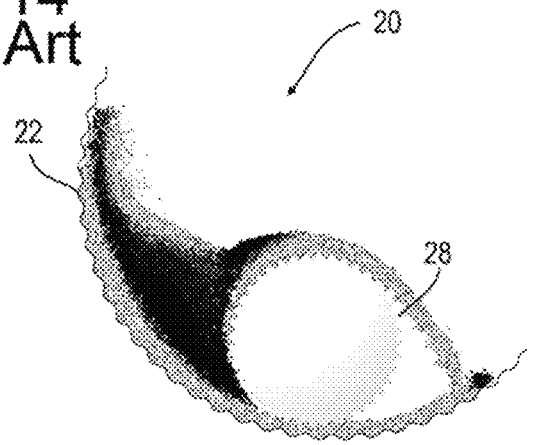
FIG. 16 is a cross sectional end view of the example of the MRGM shown in FIG. 12.

In one example the ratio of the protrusions on the roller 28 is configured to maximize efficiency. In the example shown in FIG. 12, the relative size of the ramp-shaped protrusions 32/34 is equivalent, whereas the example shown in FIG. 15 shows arcuate protrusions 32/33 having equivalent size. In each example, the number of protrusions 32 on the roller 28 is less than the number of protrusions on the shell 22 resulting in the roller 28 rotating at a faster angular velocity than the shell 22. The example shown in FIG. 16 shows a greater number, and smaller size protrusions 32 on the roller, resulting in a more similar angular velocity between the roller 28 and the shell 22. Where the number of protrusions around the roller 28 equals the number of protrusions on the shell 22, the relative angular velocity will be the same (they will rotate at the same speed).

In some embodiments, one or both of the shell 22 and roller 28 may have ridges 84 and/or grooves 86 as shown in FIG. 3, 5, 7 to increase surface contour to better grip and retain material 38 entering the compression zone 78. In this embodiment, the ridges may also impart shear stresses due to differential speeds between shell 22 and roller 28.

Figure 13:
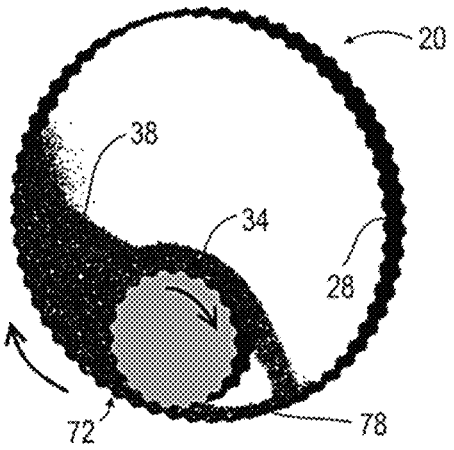
FIG. 13 is a cross sectional perspective end view of one example of the MRGM in use.

FIG. 13 is a perspective view of a portion of an embodiment of a MRGM 20 illustrating material 38 (rock) being crushed in the mill 20. The material 38 may then reposition toward the compression zone 78 and as the anvil 22 and roller 28 rotate, the material 38 is compressed between the anvil 22 and roller 28 as the gap 72 between the anvil 22 and roller 28 decreases into the compression zone 78. As depicted in the embodiment of FIG. 2, material 38 that is smaller than the exit grates (openings) 70 passes through the outer surface 66 of the roller 28. Non-ejected material 38 may remain in the MRGM 20 and return to the compression fracture zone 78 where it will eventually be ejected. Ejection may also occur past the shield 40 as previously described.

In one embodiment as shown in FIG. 1, the shield 40 may include an open region such that the rock which does not pass through the openings 70 when provided, may be ejected through the ejection port 96 along the direction of flow.

Additionally, the holes 70 in the grates of the shell 22 or laterally inward of the ejection port 96 may be sized according to the degree of comminution desired. For example, if it is desired that the largest resultant crushed material 38 have a maximum diameter of 50 mm then the grates 70 of the apparatus would have an inner diameter (width/length) of 50 mm. Additionally, the grates 70 may have different dimensions in other directions, for example, a hole may have a 50 mm width and a 150 mm length, where the length may be in the direction circumferentially around the inner surface of the outer ring. The size of the hole 70 may also be selected to reduce power consumption (as there is a pronounced increase in power consumption for a relatively small percentage change in hole size).

One significant disadvantage of prior art high pressure grinding roll (HPGR) and other crushing mills is that material would often jam between the shield and one or both rollers. In many prior art applications, the shield is static, and does not rotate with the shell 22, further causing material to jam between the shield and the other components. This problem has been at least partially alleviated herein a where the shield 40 of one example is attached to the shell 22 either permanently or removably and rotates therewith. Thus, the shield(s) 40 will generally hold material 38 within the chamber 24, and any material that would lie against the shield 40 in the compression zone 78, will be compressed therein.

A mono roll grinding mill using a roller with no external pressure device substantially reduces capital cost, complexity and operating costs. Further, an un-driven roller in such an arrangement also substantially reduces capital cost, complexity and operating costs. Despite this no such mono roll grinding mill with floating roller exists in the prior art, despite numerous benefits outlined herein.

While the present disclosure is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The disclosed apparatus and method in their broader aspects are therefore not limited to the specific details, representative apparatus and methods, and illustrative examples shown and described. Accordingly, departures may be made from such details without departing from the spirit or scope of applicants' general concept.

I claim:

1. A mono roll grinding mill (MRGM) comprising:

a shell having a chamber having a cylindrical inner surface, wherein at least a portion of the inner surface of said shell comprises a first plurality of ridges extending along an axial direction of said shell;

a floating roller located within the shell, said roller comprising a cylindrical outer surface, wherein at least a portion of the outer surface of the roller comprises a second plurality of ridges extending along an axial direction of said roller;

wherein the shell is configured to rotate about a shell axis, said shell axis being offset from and parallel to a roller axis;

wherein the MRGM is configured to receive material in the chamber, and wherein said material is comminuted by a weight of said roller without an external pressure system in a fracture zone located between the inner surface of the shed and the outer surface of the rover, and wherein said first plurality of ridges and said second plurality of ridges extend helically in said axial direction of said shell and configured to control a number of circumferential passes of said material through said fracture zone.

2. The MRGM of claim 1, further comprising exit grates extending through the shell to allow comminuted material to pass radially outward therethrough.

3. The MRGM of claim 1, wherein the roller contains a volume of solids and/or fluid to increase the weight of said roller.

4. The MRGM of claim 1, wherein the shell rotates at a first angular velocity and the roller rotates at a second angular velocity different from the first angular velocity.

5. The MRGM of claim 1, further comprising a ring-shaped shield attached to a laterally outward portion of the shell on at least one lateral end of the shell and configured to rotate therewith.

6. The MRGM of claim 1, wherein the roller has an outer diameter greater than 0.2 of the shell inner diameter.

7. The MGRM of claim 1, wherein said first plurality of ridges and said second plurality of ridges are substantially orthogonal in said fracture zone.

8. The MGRM of claim 1, wherein said first plurality of ridges is complementary in shape with said second plurality of ridges.

9. The MGRM of claim 1, wherein said first plurality of ridges and said second plurality of ridges form a worm gear configuration.

10. The MGRM of claim 1, wherein said material is received at a first end of said chamber, and wherein said material is ejected from a second end of said chamber opposite said first end of said chamber.

11. The MGRM of claim 1, wherein said plurality of protrusions is circumferentially asymmetrical.

12. The MGRM of claim 1, wherein at least one of the shell and/or the roller are frustaconic in the axial direction.

13. The MGRM of claim 1, wherein torque is transmitted from said shell to said roller to effect rotation of said roller.

14. The MGRM of claim 1, wherein the shell and/or the roller comprise a rounded edge configured to maintain an axial position of the roller within said chamber.

* * * * *